US005871589A

United States Patent [19]

Hedge

[11] Patent Number: 5,871,589

[45] Date of Patent: Feb. 16, 1999

[54] GUN BARREL AND TUBE CLEANING DEVICE

[76] Inventor: Bruce F. Hedge, 3734 N. 39th St., Boise, Id. 83702

[21] Appl. No.: 790,676

[22] Filed: Jan. 28, 1997

Related U.S. Application Data

[63] Continuation-in-part of Ser. No. 719,791, Sep. 25, 1996, abandoned.

[51] Int. Cl.[6] ..... F41A 29/00; B08B 9/02

[52] U.S. Cl. ..... 134/8; 42/95; 15/104.16; 15/104.2; 15/114

[58] Field of Search ..... 15/104.16, 104.165, 15/104.2, 164, 206; 134/114, 6, 8; 42/95

[56] References Cited

U.S. PATENT DOCUMENTS

| | | | |
|---|---|---|---|
| 821,198 | 5/1906 | Stocker . | |
| 882,598 | 3/1908 | Ward . | |
| 1,061,119 | 5/1913 | P'Pool . | |
| 2,544,290 | 3/1951 | Bailey | 15/104.16 |
| 2,897,525 | 8/1959 | Goodwin et al. | 15/104.165 |
| 3,205,518 | 9/1965 | Romaine | 15/104.165 |
| 3,360,818 | 1/1968 | Edwards | 15/104.16 |
| 3,708,820 | 1/1973 | Schultea | 15/104.16 |
| 4,010,565 | 3/1977 | DiProspero | 42/1 R |
| 4,222,142 | 9/1980 | DiPrspero | 15/104.165 |
| 4,399,327 | 8/1983 | Malesky et al. | 42/1 BC |
| 4,399,627 | 8/1983 | Malesky | 15/104.16 |
| 4,657,597 | 4/1987 | Wolf et al. | 134/8 |
| 4,680,824 | 7/1987 | Lieptz | 15/104.165 |
| 4,716,673 | 1/1988 | Williams et al. | 42/95 |
| 4,776,125 | 10/1988 | Black et al. | 42/95 |
| 5,060,336 | 10/1991 | LaLonde | 15/104.1 R |
| 5,171,925 | 12/1992 | Mekler | 42/95 |
| 5,357,705 | 10/1994 | Stengel | 42/95 |
| 5,588,242 | 12/1996 | Hughes | 15/104.16 |

*Primary Examiner*—Randall E. Chin
*Attorney, Agent, or Firm*—Joseph W. Holland

[57] ABSTRACT

This device is a cleaning tool for cleaning the inside of gun barrels. The device consists of a metal brush which is enclosed within a tubular sheath of material, typically a woven fabric. The bristles of the brush extend through the wall of the woven sheath of fabric. The tubular sheath is pulled through a gun barrel and the bristles of the brush clean the inside of the gun barrel. Also enclosed within the tubular sheath are one or more foam inserts, or one or more cleaning regions formed by folding the cord within itself, either of which creates a bulge in the tubular sheath and cleans debris from the gun barrel, spreads gun cleaning solvent in the gun barrel, absorbs solvent and combustion and bullet residues, and spreads a layer of gun oil in the gun barrel.

24 Claims, 8 Drawing Sheets

GUN BARREL AND TUBE CLEANING DEVICE

This application is a Continuation-in-Part of application Ser. No. 08/719,791, filed Sep. 25, 1996, now abandoned, entitled GUN BARREL AND TUBE CLEANING DEVICE.

BACKGROUND OF THE INVENTION

1. Technical Field

The present invention generally relates to devices for cleaning the inside of tubes and more particularly to devices for cleaning the inside of gun barrels.

2. Background

When a bullet is fired in a gun, explosive chemicals inside the cartridge are ignited. This ignition causes a rapid production of ignition gasses, which expand and push the bullet away from the brass casing. The expanding gasses cause the bullet to move rapidly through the barrel of the gun and to exit the barrel. Inside the barrel of most modern guns there are fairly delicate spiral cut grooves, called riflings, which cause the bullet to rotate as it passes down the barrel and over the rifling. The rotation of the bullet as it leaves the barrel greatly enhances the accuracy of its flight. It is very important for improved shooting accuracy that riflings retain their accurately machined surfaces. As the bullet passes through the gun barrel, it touches the side of the gun barrel and leaves traces of metal. In addition to metal deposited by the bullet, the expanding gasses of combustion leave residues on the inside of the barrel. Both of these deposits can build up with repeated firings. In an extreme condition, deposits of bullet material as well as residues of combustion can build up on the walls of the gun barrel to a point that accuracy is affected and back pressures may become dangerously high.

To prevent this build up of material inside the gun barrel, deposits within the gun barrel must be removed by cleaning. Traditionally, cleaning of gun barrels is accomplished either by forcing a wire brush through the gun barrel, or by forcing an oiled or solvent saturated cloth through the gun barrel. Often these operations are performed sequentially. One widely used method for cleaning gun barrels in this manner is by the use of a rigid aluminum rod which is in short sections approximately 8" long. The ends of each section are threaded and screwed together. On the end of an assembled rod, utensils are screwed into the rod. These utensils can include a wire brush or a slotted metal tool into which a cloth patch or swab is inserted. Solvent can be applied to the cloth patch or brush to help loosen hardened residues in the barrel. The metal brush is pushed completely through the barrel and pulled out again. The metal brush is most effective in loosening metal particles and other hardened residues inside the gun barrel. After the barrel has been treated with a metal brush, clean swabs are usually run through the barrel to absorb the solvent and loosened residue. The final step in the process is usually another clean swab to which a small amount of light gun oil is applied. This leaves a layer of oil on the metal of the barrel to protect from rust and corrosion.

The use of a sectional rod with utensils at its end has several disadvantages. It requires assembly, disassembly, changes of attachments and several patches during the process. Thus it is time-consuming and complex to use. Another shortcoming is that patches and cloth pieces when passed through the slot of such a cleaning device and pushed into the barrel of a gun will compress around the rod. The patch or cloth may be loose in the barrel, depending on the diameter of the rod and the thickness of the patch. Even if the rod and cloth are sized to provide a firm fit between the rod and the gun barrel, the contact of the patch with the surface of the gun barrel is inherently uneven because the cloth bunches. Additionally, this becomes a problem if an oversized cloth binds in the barrel and becomes stuck.

Another problem with the use of rigid rods with utensils at their end is the inability of such combinations to make mid-bore directional changes. In the use of such a rigid rod, it is the usual practice to push the utensil, either the brush or the patch, entirely through the barrel.

However, sometimes the user will reverse the direction of the rod part way through the bore. When this happens, a cloth patch, especially a thick one which provides good contact and cleaning characteristics, is forced to reverse upon itself and may jam in the barrel. This may result in the utensil tip of the rod breaking off inside the gun barrel. In some instances it is required that gunsmith tools and techniques be used to remove the jammed utensil.

In the case of a brush performing a mid-bore directional change, the wires of the brush are forced to change from a sloped back angle to a sloped forward angle. This change in alignment of the brush filaments can increase the resistance of the brush traveling through the barrel by 400%. This can result in the brush being broken off from the rod or the rod itself breaking, usually at a threaded connection.

A rod device may be able to make a mid-bore directional change with a small cloth if the small cloth is square, round or of some other non-elongated type, and if the user is careful. However, these cloths lack enough surface area to be effective to clean the inside of the barrel in this back and forth or "see-saw" manner. They become "loaded up" with residues. Also, they will at times "double up" upon themselves and get stuck in the bore. As previously stated, elongated patches have a somewhat greater surface area, and therefore are more effective at absorbing residues, but any attempt to "see-saw" with elongated cloths can result in the extremely difficult problem of "doubling up" and jamming in the barrel. Other cleaning devices are simply not "foolproof" in this regard, and in the real and practical world many problems result.

Regarding rifle barrels and forces required to push objects through, an explanation follows:

Approximately eight to fifteen pounds of force are required to push a brush through a worn but still usable barrel in clean condition. Approximately nine to eighteen pounds of force are required to push a metal brush through a worn but still usable barrel which is in need of cleaning.

Approximately ten to twenty-two pounds of force are required to push a wire brush through new barrels or barrels with little wear and which are in clean condition. Approximately ten to twenty-five pounds of force are required to push a wire brush through new barrels or barrels with little wear which are in need of cleaning. Approximately twenty to forty pounds of force are required to remove unusually large, stubborn and hardened amounts of build up from the inside of a barrel. Ninety pounds of force or more may be necessary to remove severely jammed, oversized gun cleaning cloths that have "doubled up" and wedged with a broken cleaning tip. Sometimes these jammed tips require the services of a gunsmith to remove.

Another problem with current cleaning devices is that they contain exposed metal parts. A wire brush typically in use in the industry consists of steel spiral wire in which relatively soft, phosphor-bronze metal bristles of the brush are bound. The spiral wire of these wire brushes is exposed at the end. Many devices also contain fittings, connections, clamps, crimps, wires, push rod tips and other metal parts. Any of these metal parts can, either by poor design, misuse, carelessness, or accident, be damaging or abrasive to sensitive rifle barrel areas, especially the throat, rifling and crown. Damage to these areas is an especially important consideration to knowledgeable gun owners including: marksmen, long-range shooters and owners of fine, high-grade rifles and pistols. Damage to these areas often occurs when cleaning utensils are inserted into the barrel. At the moment of insertion, the rod or utensil may be at an angle to the long axis of the barrel, and this can allow the tip of the wire brush to touch the sides of the barrel or the rifling of the barrel. Any hardened metal-to-metal contact with the rifling or the barrel can cause damage.

Other pull-through devices make use of connections on the main body of the flexible wire or cord. These connections require knots or other stitched, glued, twisted, melted, crimped, soldered or injection molded connections. All of these connections increase the size and/or decrease the compression potential at the connection site, thus requiring the use of a smaller diameter cord or wire than would otherwise pass through the barrel. The smaller cord or wire decreases strength, durability, and ease of grasping. Additionally, connections often have a greater propensity to be defective or to wear, break or otherwise separate.

Some cleaning devices utilize a cord which is pulled through the barrel, and drags a cloth patch, but which does not contain a metal brush feature. These pull-through devices are typically in the nature of a thick woven wick or rope-like cord. Such a wick or rope-like cord contacts the gun barrel along its entire surface. This requires that the resistance along the entire surface of the wick be a fairly low pressure against the inside of a gun barrel. A high pressure would make the wick impossible or difficult to pull through the gun barrel.

Sometimes a gun barrel will have dirt, mud, sand, ice, or other environmental debris in the gun barrel. If this material is abrasive, such as sand or dirt, it is preferable that this abrasive material be removed before a metal brush is passed through the barrel. If a metal brush is passed through a sandy or dirty barrel, the sand and/or dirt become embedded in the bristles of the brush and are ground into the gun barrel as an abrasive. This can scratch and cause uneven wear to the gun barrel and the rifling. A preferable technique is to use a utensil to clean out such environmental debris before the metal brush goes through the barrel. Current barrel cleaning devices do not provide a means of doing this except to add another step to the process and run a clean patch in and then out of the barrel. To do a good job of cleaning environmental debris from a barrel, three or more clean patches might be required. Since sand and dirt are most likely to be in a barrel during field conditions, such an inconvenient cleaning process is not likely to be utilized, even if the user has gone to the trouble of carrying a cleaning kit with him or her.

All cleaning devices in use today require assembly, changing of fittings, and/or changing of cloths or patches prior to and during their use. This is always an inconvenience and it can prove to be a detrimental disadvantage under tense circumstances, tight time constraints, bad visibility or severe environmental conditions. Many cleaning devices require specialized storage compartments or containers.

Accordingly, it is an object of the invention to provide a gun barrel cleaning device which performs several cleaning functions with one pass through the barrel of a gun, thus saving the user a great deal of time and trouble. Among the steps that can be accomplished in one pass of the cleaning device through the gun are (1) removal of environmental debris from the barrel prior to and separate from the use of a bore brush (2) distribution of cleaning solvent onto the inner surface of the barrel (3) cleaning the barrel with a metal wire brush (4) absorbing solvent and picking up residues loosened by the wire brush, and (5) distributing a thin layer of light gun oil in the barrel.

Another object of the invention is to provide a gun barrel cleaning utensil which eliminates the possibility of metal-to-metal contact with the gun barrel itself.

A further object of the invention is to provide a gun barrel cleaning device which eliminates the possibility of broken cleaning rod tips, broken cleaning rods, jammed cleaning utensils, or stuck patches, cloths or brushes by providing for foolproof mid-bore direction changes.

Another object of the invention is to provide a gun barrel cleaning utensil which is light weight, easily carried under field conditions, and which reduces or eliminates the metal parts typically used in a cleaning device.

Another object of the invention is to provide a gun barrel cleaning device which eliminates assembly, disassembly, changing of parts, changing of patches, etc., and is always ready to use.

Additional objects, advantages and novel features of the invention will be set forth in part in the description which follows, and in part will become apparent to those skilled in the art upon examination of the following, or may be learned by practice of the invention. The objects and advantages of the invention may be realized and attained by means of the instrumentalities and combination particularly pointed out in the appended claims.

DISCLOSURE OF INVENTION

According to the present invention, the foregoing and other objects and advantages are obtained by a tube cleaning device which is useful for cleaning the inside surface of a variety of different kinds of tubes. This could include the inside of gun barrels. It could also include other tubes, such as food processing lines, chemical processing lines, sewage treatment pipes, or any other structure of a tubular nature. This tube cleaning device consists of a brush and a tubular sheath. The brush has a brush body in which bristles are anchored. The bristles extend from the brush body. The brush body is enclosed within and surrounded by the tubular sheath. The bristles of the brush extend through the wall of the tubular sheath. This device works by pulling the tubular sheath through the tube with the bristles of the brush extending out from the tubular sheath. In this manner, the bristles of the brush clean the inside surface of the tube or gun barrel. In this embodiment of the invention, the tubular sheath would typically be composed of a woven fabric. In the best mode of the invention, the tubular sheath is made of a woven multi-strand hollow cord which has a sufficiently loose weave to allow the insertion of a splicing tool or other object approximately equal to the inside diameter of the tube being cleaned without damaging said weave of the cord when the splicing tool or other object is removed from the cord. The cord found to be best suited is a texturized cord.

In accordance with another aspect of the invention, the invention consists of a tube-cleaning device for cleaning the inside surface of gun barrels. This aspect of the invention includes a foam insert which is inserted in and surrounded by a tubular sheath. One aspect of this invention is one in which the tubular sheath is made of a woven fabric. In this aspect of the invention, the tubular sheath with its enclosed foam insert is drawn through the inside of a gun barrel, and the foam insert resists compression by the walls of the gun barrel, which causes the foam insert to press the woven fabric of the tubular sheath firmly against the inside surface of the gun barrel. In this aspect of the cleaning device, one or more foam inserts can be inserted and enclosed within the tubular sheath. In place of foam inserts, the tubular sheath can be folded in upon itself and sewn in that folded position to form a cleaning section. In the best mode of the invention, the tubular sheath is made of a woven multi-strand hollow cord which has a sufficiently loose weave to allow the insertion of a splicing tool or other object approximately equal to the inside diameter of the tube being cleaned without damaging said weave of the cord when the splicing tool or other object is removed from the cord. The cord found to be best suited is a texturized cord.

In accordance with another aspect of the invention, the cleaning device is used for cleaning the inside of the tube, such as a gun barrel, by performing one or more cleaning steps on one pass through the tube. The cleaning device is designed so that it is incapable of jamming in the tube as the result of a mid-bore direction change. The cleaning device of this version of the invention includes a brush, which itself has a brush body and bristles, which are anchored in and extend from the brush body. This device also has one or more cleaning sections, which are located adjacent to the brush body, and serve the purpose of contacting and cleaning the inside surface of the tube being cleaned. This version of the cleaning device also includes a flexible cord which is attached to an end of a cleaning section or to an end of the brush, and which is used to pull the cleaning sections and the brush through the tube to clean the inside surface of the tube. This flexible cord can be the tubular sheath in which the brush and the cleaning sections are enclosed. The cleaning sections of this version of the cleaning device can be foam inserts which are inserted into and enclosed by the tubular sheath. The cleaning sections can also be made from regions of the tubular sheath which are folded upon itself. The tubular sheath of this device can be composed of a woven fabric. In the best mode of the invention, the tubular sheath is made of a woven multi-strand hollow cord which has a sufficiently loose weave to allow the insertion of a splicing tool or other object approximately equal to the inside diameter of the tube being cleaned without damaging said weave of the cord when the splicing tool or other object is removed from the cord. The cord found to be best suited is a texturized cord. This cleaning device can also include a weight attached to an end of the tubular sheath. This cleaning device can also be designed such that the flexible cord of the cleaning device is a vinyl-covered cable, which is attached to the cleaning sections and the brush body and pulls them through the tube to be cleaned.

In accordance with still another aspect of the invention is a device for cleaning the inside surface of gun barrel by performing one or more cleaning steps which can occur on one pass through the barrel. This gun barrel cleaning device is designed so that it is incapable of becoming jammed in the barrel by a mid-bore direction change. This version of the cleaning device includes a brush, which itself includes a brush body and bristles which are anchored in and extend from the brush body. It also includes one or more tubular sheaths of woven fabric in which the brush body is enclosed and through which the bristles of the brush extend. If using one tubular sheath, the brush is inside the hollow cord. If using more than one tubular sheath, the brush is sandwiched between two or more tubular sheaths. The tubular sheath of woven fabric is pulled through the gun barrel and the bristles which extend through the woven fabric clean the inside surface of the gun barrel. This cleaning device also includes one of several optional variations for cleaning particulates and/or liquids from within the barrel from the gun barrel, either before or after the passage of the brush through the gun barrel. In one variation of this device, the provision for cleaning particulates and/or liquids from the gun barrel is the use of one or more resilient foam plugs which are enclosed within the tubular sheath of woven fabric. These resilient plug inserts are resistant to compression, and when pulled into the gun barrel, press the tubular sheath of woven fabric more firmly against the inside surface of the gun barrel, thus causing the woven fabric to pick up any environmental debris in the barrel, distribute cleaning solvent onto the inside surface of the barrel, pick up metal particles and other residues loosened by the brush, pick up gun cleaning solvent and combustion residue from the inside surface of the gun barrel, and distribute a layer of light gun oil onto the gun barrel. The resilient plug inserts can be made of a nonabsorbent closed cell foam. They can also be made of an absorbent foam. In the best mode of the invention, the tubular sheath is made of a woven multi-strand hollow cord which as a sufficiently loose weave to allow the insertion of a splicing tool or other object approximately equal to the inside diameter of the tube being cleaned without damaging said weave of the cord when the splicing tool or other object is removed from the cord. The cord found to be best suited is a texturized cord. The cleaning section can be formed by a region of cord which is folded upon itself. This gun barrel cleaning device can include a section which is specifically designed to deposit a layer of oil on the inside surface of the gun barrel after the passage of other cleaning and brushing components of the cleaning device. This oiling section or oiling wick can be the frayed end of a hollow-core woven cord, in which the hollow-core woven cord is partially inserted into itself with the frayed end protruding. This version of the gun barrel cleaning device can include a weight which is attached to one end of the tubular sheath. This weight could be dropped through the gun barrel in order to allow the user to grasp it and pull the rest of the gun barrel cleaning device through the gun barrel. One optional variation of this is for a rigid or semi-rigid section to be attached to the weight. This rigid or semi-rigid section would be optionally used to dislodge a blockage in the gun barrel, such as dirt, mud or ice, which would otherwise prevent the weight on the tubular sheath from dropping through the barrel.

This invention provides a way to clean a tube, and most particularly a gun barrel, with a number of cleaning steps achieved in one pass of the cleaning device through the gun barrel. With one pass of the device through the gun barrel, environmental debris is removed, gun cleaning solvent is distributed, metal from bullets and combustion residues are scrubbed off the gun barrel by a metal brush, solvent is absorbed and removed from the gun barrel along with particles of metal and combustion residues, and a layer of light oil is distributed on the inside surface of the gun barrel. This gun cleaning device can also be made such that no metal components (other than the intended industry standard, soft, phosphor-bronze bristles) can touch the inside surface of the gun barrel, which eliminates scratching, scarring, or uneven abrasion of the crown of the gun barrel, the riflings or other barrel metals.

Still other objects and advantages of the present invention will become readily apparent to those skilled in this art from the following detailed description, wherein I have shown and described only the preferred embodiments of the invention, simply by way of illustration of the best mode contemplated by me of carrying out my invention. As will be realized, the invention is capable of modifications in various obvious respects, all without departing from the invention. Accordingly, the drawings and description are to be regarded as illustrative in nature and not as restrictive.

BEST MODE FOR CARRYING OUT INVENTION

Figure 1:
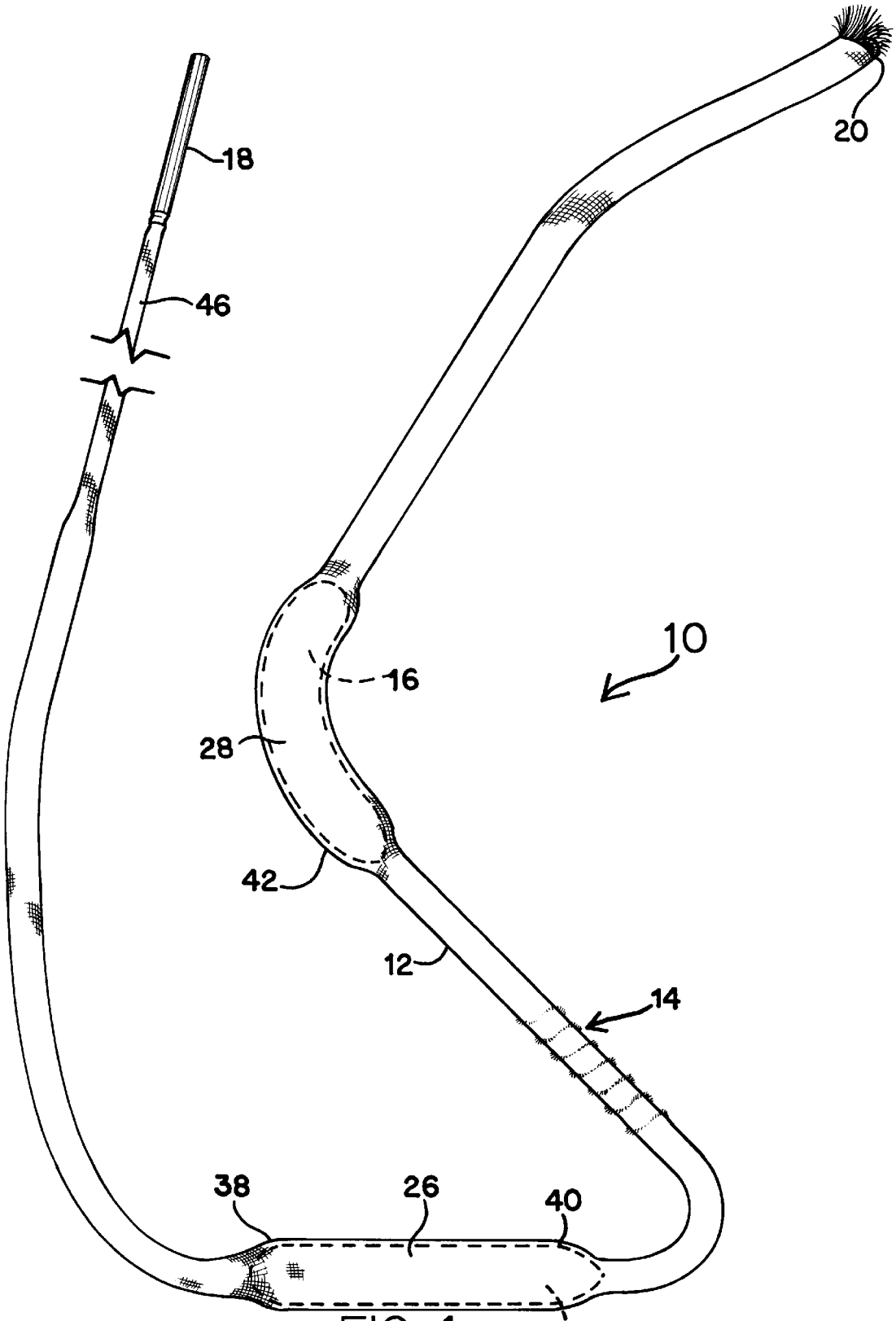
FIG. 1 is a top view of the gun barrel cleaning device.
Figure 2:
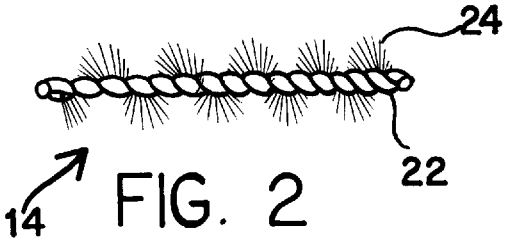
FIG. 2 is a side view of the wire brush for use in the invention.
Figure 3:
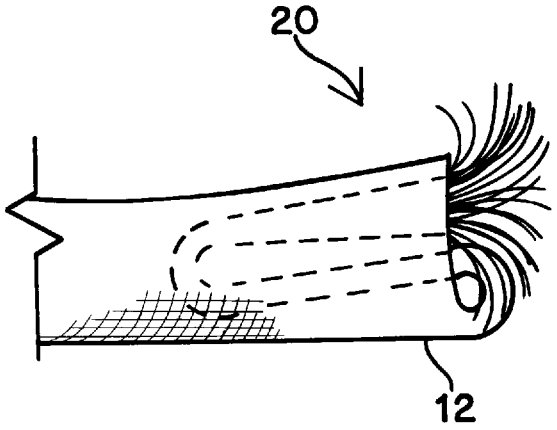
FIG. 3 is a side view of the oiling wick of the invention.
Figures 10, 10A:
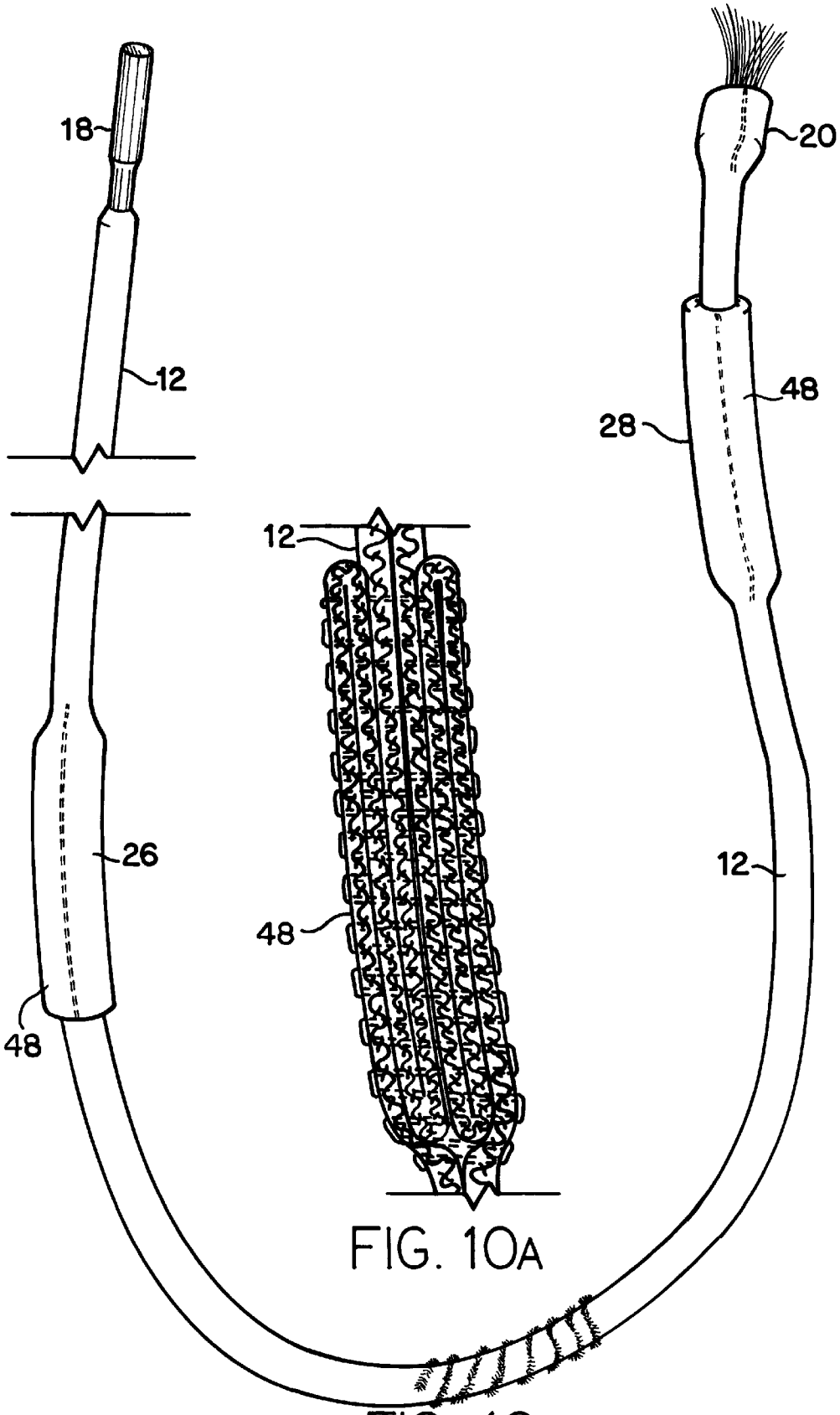
FIG. 10 is a top view of a gun barrel cleaning device with folded tubular sheath sections forming the cleaning sections.
FIG. 10*a* is a cross sectional view of a cleaning section formed by folding a region of tubular sheath upon itself.

Referring to FIG. 1, the invention is shown to advantage. Cleaning device 10 includes a tubular sheath 12, brush 14, optional foam insert 16, a cleaning section 26, a cleaning section 28, weight 18, cord 46 and oiling wick 20. The cleaning section 26 and 28 can be made from folded section 48 of tubular sheath 12, as shown in FIG. 10 and 10*a*. The brush 14 is shown in its interior structure in FIG. 2 and includes brush body 22 and bristles 24. Oiling wick 20 is shown in more detail in FIG. 3. In a preferred embodiment of the invention, oiling wick 20 is formed from tubular sheath 12 which is folded in upon itself with its frayed end extending from the insertion. Oiling wick 20 can also be formed from a loop or fold of tubular sheath 12.

Figure 11:
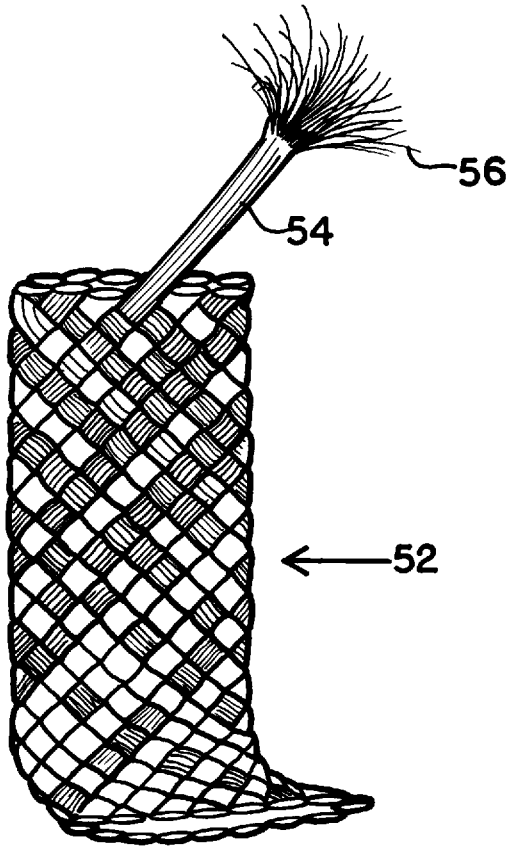
FIG. 11 is a side view of a 16 strand loose weave hollow cord tubular sheath.
Figure 12:
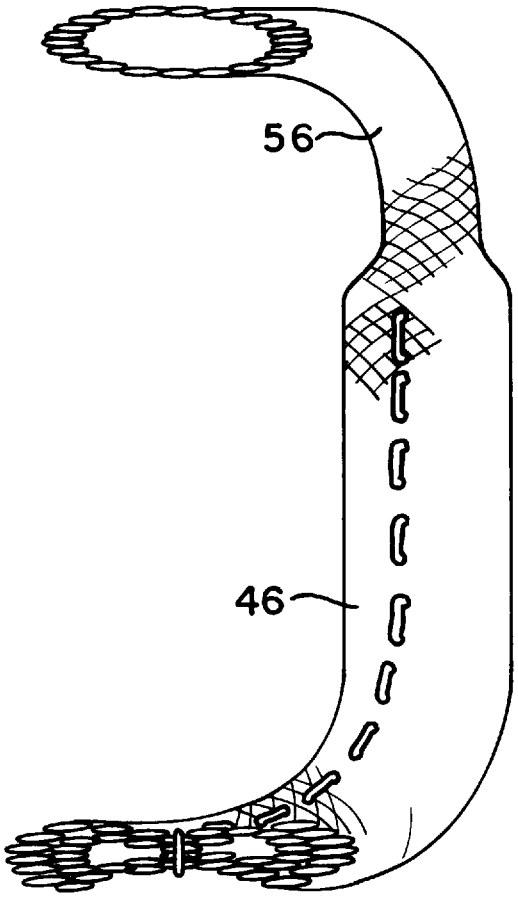
FIG. 12 is a side view of a folded section of a 22 strand loose weave hollow cord tubular sheath, with a cross sectional view of a folded section.

The preferred woven fabric of which the tubular sheath 12 is composed (for smaller caliber gun bores) is 7/16" hollow braided cord 52, of sixteen woven strands, with 270 fibers per strand 54, as shown in FIG. 11. For larger caliber gun bores, a similar cord 56, 5/8" in diameter, with 22 woven strands 54, is used, as shown in FIG. 12. Both of these cords are "texturized". This means that each filament 56 of these cords is wavy, kinky, or "zig zagged" in shape. When a large number of these filaments are grouped together, the tubular sheath 12 has considerable resiliency. When a section of this type of material is folded in upon itself, as shown in FIGS. 10 and 10A, creating a section which is a tube within a tube, that section has considerable resiliency and applies pressure to the inside walls of the gun bore being cleaned. Yet when one "tube" is pulled, the stitching transmits the pull to the inner tube and the tubular sheath acts like a seamless tube body. Two thicknesses allows a brush body 14 to fit in the thinner single tube area. In the area doubled up by insertion into itself, the cord acts much like resilient foam for the purpose of traveling through the bore, but with the additional benefit of longitudinal strength, durability and chemical resistance of the cord material, which is generally nylon or polyester.

Loose weave cords of texturized fibers are shown in FIGS. 11 and 12. The fibers of this hollow braided cord are rough textured multi-filament nylon, but polyester, cotton, or other materials can also be used. This cord has a fuzzy and not a smooth texture. This texture provides a good grip to the user and also provides increased resilience and friction and absorption for cleaning the inside surface of the gun barrel. This type of cord is extremely loose weave, non-existent on a retail basis, and specifically manufactured by a cord manufacturing company for the purpose of this invention. Since the fibers of this type of material lay flat, are not twisted and are of unusually loose weave, the splicing tool 34 can be inserted between the strands and can exit at another point and not damage the weave of the fabric. A characteristic of this cord is that a splicing tool or other object which is about the diameter of the gun barrel to be cleaned can be inserted through one wall of the cord and out another wall of the cord, without damaging the weave of the cord.

This embodiment of the invention also includes a cord 46 which is attached to tubular sheath 12. The cord 46 is preferably 3/16" parachute cord. Attached to the end of cord 46 is weight 18. Cord 46 is attached to weight 18 by first applying a small amount of epoxy to the end of cord 46. This epoxied cord is inserted into the interior of weight 18. Weight 18 is then crimped and the epoxy on cord 46 is allowed to dry. Once the epoxy of cord 46 dries, this connection exceeds the strength of the parachute cord of cord 46. The weight 18 is a 3/16" diameter copper or brass tube cut to length, and crimped on its end. Obviously, other configurations of weight can be utilized with equal success.

The brush 14 of this invention is sized according to the caliber of gun barrel. A bullet diameter of 0.224 requires the use of a brush with a diameter of 0.234 inches. A bullet diameter of 0.243, which includes a 6 mm Remington, requires a brush diameter of approximately 0.253 inches. A bullet diameter of 0.257 requires a brush diameter of 0.267. A bullet diameter of 0.263 requires a brush diameter of 0.273. A bullet diameter of 0.277 requires a brush diameter of 0.287. A bullet diameter of 0.284 requires a brush diameter of 0.294. A bullet diameter of 0.308 requires a brush diameter of 0.318. A bullet diameter of 0.32, or 8 mm requires a brush diameter of 0.335. A bullet diameter of 0.338 requires a brush diameter of 0.352. A bullet diameter of 0.357 requires a brush diameter of 0.372. A bullet diameter of 0.375 requires a brush diameter of 0.390. A bullet diameter of 0.410 to 0.458 requires a brush diameter of 0.468. A 12 gauge shotgun barrel requires a brush of 0.889 inches. Other bore sizes can be readily fitted with a brush which is slightly larger than the bore. Shorter length brushes may be used for pistols, and use of more than one brush is also possible.

The diameter of the foam insert 16 is also related to the caliber of the bullet, and ranges in size from 0.291 to 0.375 for the above calibers. The foam insert 16, used in cleaning section 28, is slightly smaller in diameter than that used in cleaning section 26, and ranges from 0.271 inches to 0.355 inches. The differential is required as the section 26 is compressed additionally by the "drag" of the brush. The "drag" of the brush causes the weave to tighten and thereby compress the forward section.

The cleaning section can be made from a folded section of the tubular sheath 12.

Figure 4:
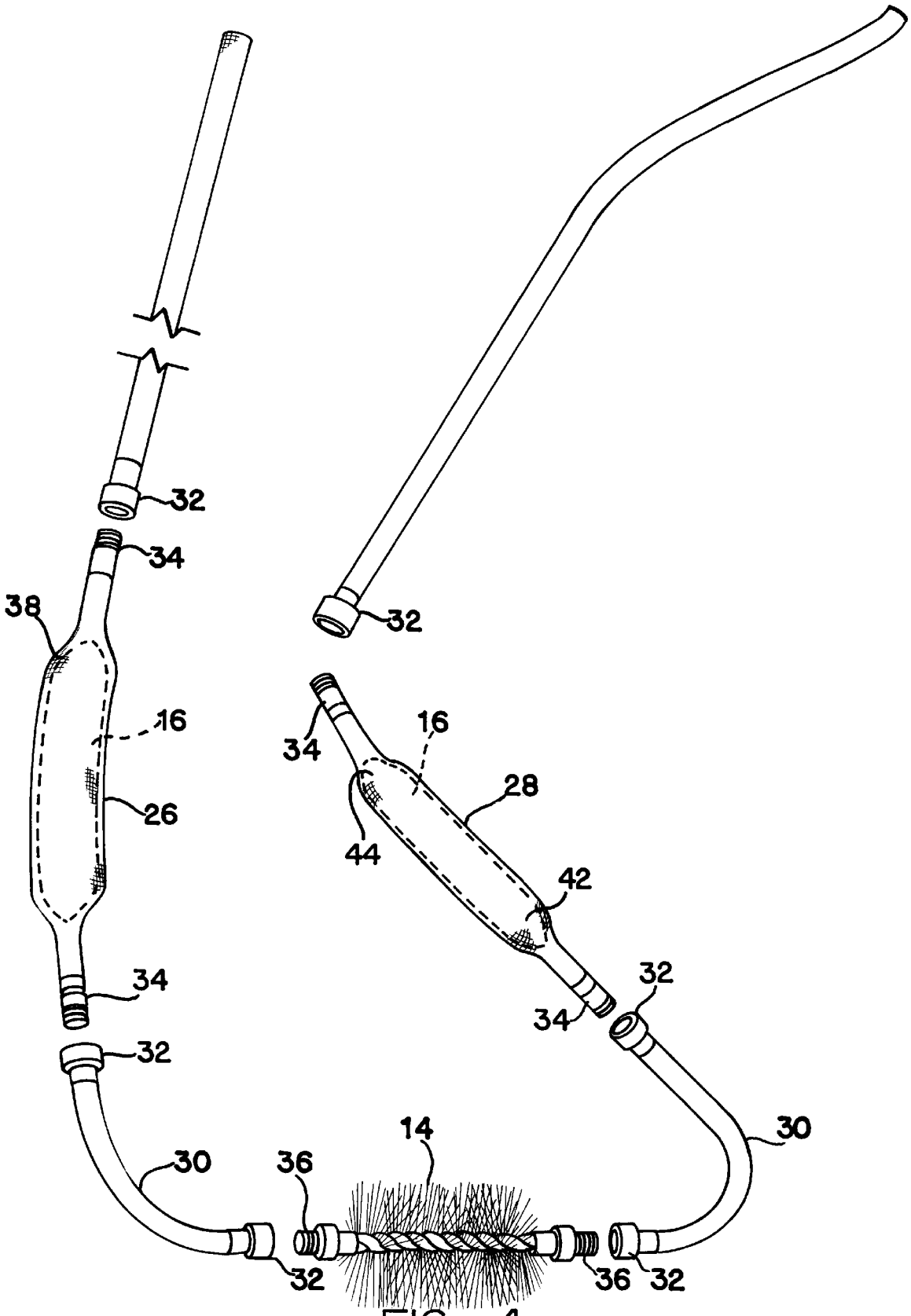
FIG. 4 is a perspective view of an embodiment of the gun cleaning device.

A second preferred embodiment of the invention is shown in FIG. 4. This embodiment includes a brush 14, a cleaning section 26, a cleaning section 28, a vinyl covered cable 30, and threaded connections 32, 50 and 36.

Figure 5:
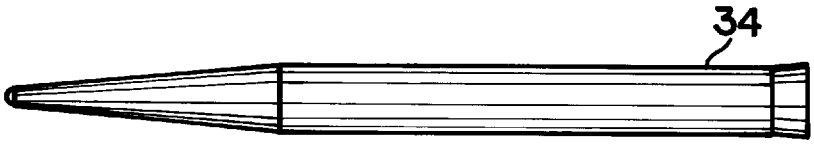
FIG. 5 is a side view of a splicing tool used in the manufacture of the invention.
Figure 6:
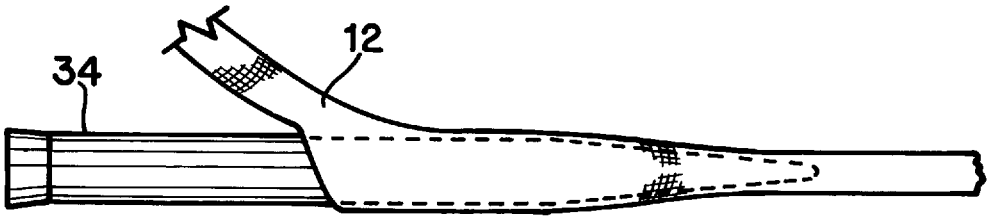
FIG. 6 is a side view of the splicing tool being inserted into a woven sheath.
Figure 7:
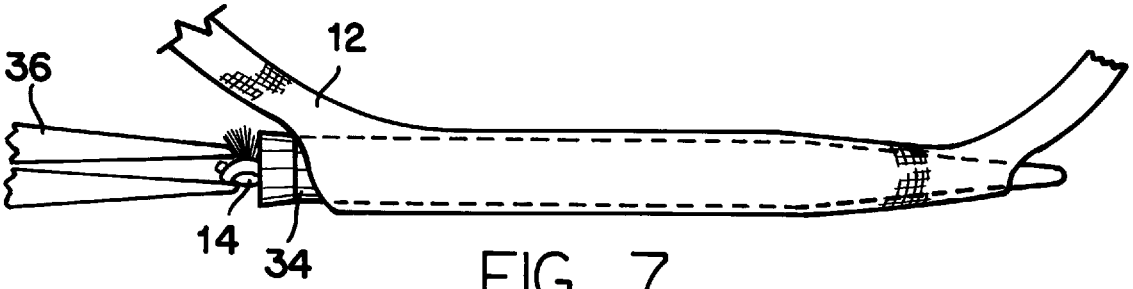
FIG. 7 is a side view of a splicing tool being inserted through a woven sheath and a wire brush being inserted into the splicing tool.
Figure 8:
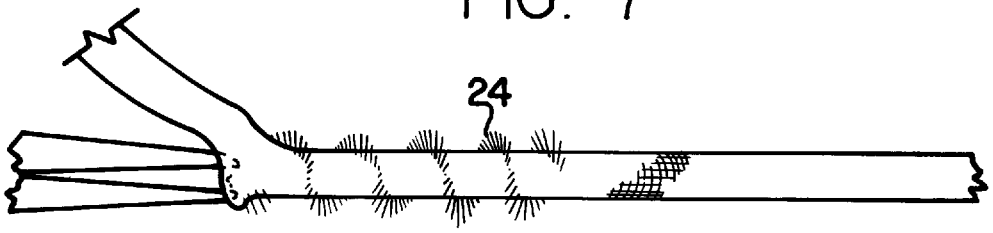
FIG. 8 is a side view of a wire brush in the woven sheath in which the splicing tool has been removed.
Figure 9:
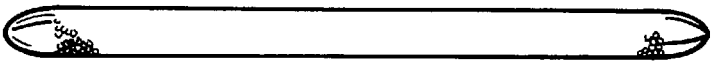
FIG. 9 is a side view of a foam insert.

In the preferred embodiment shown in FIG. 1, the cleaning device is formed by inserting brush 14 into tubular sheath 12 without cutting the fibers of tubular sheath 12. This is accomplished by the use of splicing device 34, which is shown in FIG. 5. The insertion of brush 14 is accomplished by first inserting the brush 14 into the splicing device 34. The pointed tip of splicing device 34 is then inserted between the woven fibers of tubular sheath 12. This is shown in FIG. 6. The splicing device 34 is inserted through the wall of tubular sheath 12 and out through the wall of tubular sheath 12, as shown in FIG. 7. With splicing device 34 in the position as shown in FIG. 7, brush 14 is inserted into splicing device 34. This can be accomplished by any gripping tool, such as needle nose pliers 36 which are shown in FIG. 7. With brush 14 being gripped by needle nose pliers 36 or some other gripping device, splicing device 34 is removed from its insertion in the tubular sheath 12. After splicing device 34 is thus removed, brush 14, being gripped by needle nose pliers 36 or some other gripping device, is left inside tubular sheath 12, as shown in FIG. 8. The point of insertion in tubular sheath 12 is closed behind the splicing device 34 by pulling on the cord, and the brush 14, and the bristles 24 of brush 14 extend through the wall of tubular sheath 12, as shown in FIG. 1 and 8. Foam inserts 16 are also inserted into tubular sheath 12 using the same technique. A foam insert 16 is shown in FIG. 9 and is also shown in outline in FIGS. 1 and 4.

Figure 13:
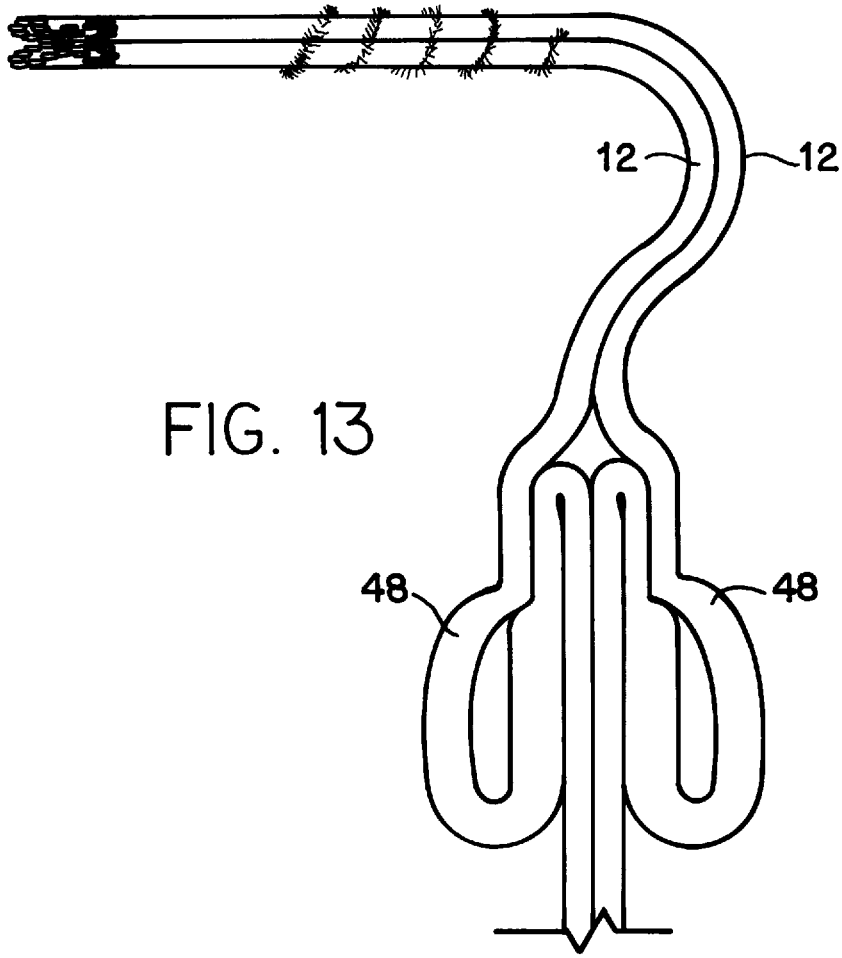
FIG. 13 is a side view of a two cord gun cleaning device, with an enclosed brush and a two loop cleaning section.
Figure 14:
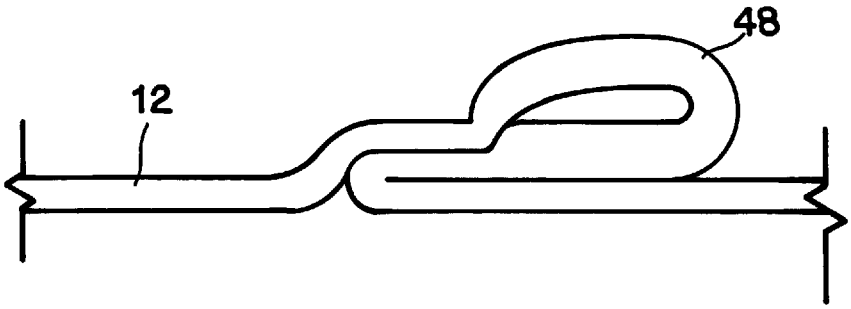
FIG. 14 is a side view of a two cord gun cleaning device, with a one loop cleaning section.

Another preferred embodiment is shown in FIG. 13. When large diameter gun barrels are to be cleaned, such as shotguns, a large brush may be sandwiched between two or more tubular sheaths 12, as shown in FIG. 13. The tubular sheaths are sewn together to a point near each end of the enclosed brush. The bristles of the brush extend through the walls of the tubular sheaths. In this configuration, foam or other inserts may be used to form cleaning sections, or one or both of the tubular sheaths may be formed into a loop, as shown in FIGS. 13 and 14.

In use, the cleaning device shown in FIGS. 1, 4, 10, or 13 is used to clean a gun barrel as follows. The weight 18 or the leading section of vinyl-covered cable 30 is inserted in the breach of a gun or at the barrel end of a gun and dropped or pressed completely through the barrel and out the opposite end. The user may then optionally apply gun solvent to the leading end 38 of cleaning section 26 and/or brush 14 and also apply a light gun oil to the oiling wick 20. The tubular sheath 12 is then firmly gripped by the user and pulled through the barrel so that the leading end 38 of cleaning section 26 enters the barrel and picks up environmental debris in the barrel, such as dirt, mud, ice, sand, etc. At the same time, gun cleaning solvent is squeezed out of the cleaning section 26 and dispersed around the inside surface of the gun barrel. As the tubular sheath is continuously drawn through the gun barrel, the brush 14 next comes into contact with the inside surface of the gun barrel. As the brush 14 goes through the gun barrel, the bristles 24 of the brush 14 contact and scrub the inside surface of the gun barrel, loosening pieces of metal and combustion residues from the explosive charges. As the cleaning section 28 enters the gun barrel, its leading edge 42 absorbs gun cleaning solvent, metal particles and loosened combustion residues within the gun barrel. As the trailing end of the tubular sheath 12 passes through the gun barrel, it drags oiling wick 20 along last. Oiling wick 20 spreads a thin layer of light gun oil through the now clean gun barrel.

In gun barrels which are exceptionally dirty or which have a large accumulation of metal due to heavy use without cleaning, the user may need to perform a "see-saw" action with the gun cleaner. This is accomplished by pulling the cleaning device back and forth in short aggressive strokes while moving the device in an overall direction through the barrel. In effect, the user is performing a multitude of mid-bore directional changes while moving the device in a general direction through the barrel.

The preferred embodiment shown in FIG. 4 is used in a similar manner. It can have an additional cleaning section attached to it after the cleaning section 28 which can act as the oiling wick, or lubricating oil can be applied to the trailing edge 44 of the cleaning section 28 to act as the oiling wick portion of the device. In this embodiment of the device, cleaning section 26, cleaning section 28, and brush 14 can be disassembled from vinyl cable 30. This provides the user with the option of assembling the device only using cleaning section 26 and brush 14 or only using cleaning section 26 without a brush and without cleaning section 28.

The preferred embodiment shown in FIG. 1 can also be constructed so that a brush 14 is not included in the device, so that cleaning section 26 is included in the device, but cleaning section 28 and the brush are not part of the device. By the use of foam inserts 16 encased in woven sheath 12, such a foam insert can provide 25 to 100 square inches of surface area. This is much more than a cloth patch could provide, and also provides a firm pressure against the wall and much improved absorptive and scrubbing abilities. The device shown in FIGS. 1, 4 and 10 is also very light in weight, made of inexpensive materials, made of materials whose strength greatly exceeds the requirements of the task of pulling this device through a gun barrel, can be reusable or disposable, and can be easily washed in a mesh bag in a washing machine or under a faucet.

In another preferred embodiment, the device is a gun barrel cleaning device made from a tubular sheath which is a multi-strand hollow cord. The cord can be made from 16 or 22 strands, as previously described, or can have fewer or greater numbers of strands. The strands are made of texturized filaments. Cleaning sections are provided in this material, which can be folded sections, loops, enclosed foam, or enclosed brushes. The innovative aspect of this embodiment is the use of this type of fabric for gun cleaning.

While there is shown and described the present preferred embodiment of the invention, it is to be distinctly understood that this invention is not limited thereto but may be variously embodied to practice within the scope of the following claims.

I claim:

1. A gun barrel cleaning device for cleaning an inside surface of gun barrel comprising:

a tubular fabric sheath having a first end, a second end and a wall; and a brush enclosed within the tubular fabric sheath, the brush including a brush body and bristles anchored in and extending from the brush body through the wall of the tubular fabric sheath, for cleaning the inside surface of the gun barrel when the gun barrel cleaning device is pulled through the gun barrel.

2. The gun barrel cleaning device of claim 1 wherein the tubular fabric sheath comprises a woven fabric.

3. The gun barrel cleaning device of claim 2 wherein the tubular fabric sheath comprises a woven multi-strand hollow cord.

4. The gun barrel cleaning device of claim 2 wherein the tubular fabric sheath further comprises a woven multi-strand hollow cord including at least one texturized filament.

5. The gun barrel cleaning device of claim 1 further comprising a plurality of brushes enclosed within the tubular fabric sheath, each of the plurality of brushes including a brush body and bristles anchored in and extending from the brush body through the tubular fabric sheath, for cleaning the inside surface of the gun barrel when the gun barrel cleaning device is pulled through the gun barrel.

6. The gun barrel cleaning device of claim 1 further comprising a flexible cord attached to the tubular fabric sheath for pulling the cleaning device through the gun barrel.

7. The gun barrel cleaning device of claim 6 further comprising a weight attached to an end of the flexible cord.

8. The gun barrel cleaning device of claim 7 further comprising a rigid or semi-rigid section attached to said weight.

9. A gun barrel cleaning device for cleaning an inside surface of a gun barrel comprising:

a tubular sheath having a first end, a second end and a wall;

a brush enclosed within the tubular sheath, the brush including a brush body and bristles anchored in and extending from the brush body through the wall of the tubular sheath, for cleaning the inside surface of the gun barrel when the gun barrel cleaning device is pulled through the gun barrel; and a cleaning section enclosed within the tubular sheath for cleaning the inside surface of the gun barrel in a multi-step cleaning process as the tubular sheath is pulled through the inside of the gun barrel.

10. The gun barrel cleaning device of claim 9 wherein the tubular sheath comprises a woven fabric.

11. The gun barrel cleaning device of claim 9 wherein the tubular sheath comprises a woven multi-strand hollow cord.

12. The gun barrel cleaning device of claim 9 wherein the tubular sheath further comprises a woven multi-strand hollow cord including at least one texturized filament.

13. The gun barrel cleaning device of claim 9 further comprising a plurality of brushes enclosed within the tubular sheath, each of the plurality of brushes including a brush body and bristles anchored in and extending from the brush body through the tubular sheath, for cleaning the inside surface of the gun barrel when the gun barrel cleaning device is pulled through the gun barrel.

14. The gun barrel cleaning device of claim 13 further comprising a plurality of cleaning sections enclosed within the tubular sheath.

15. The gun barrel cleaning device of claim 9 further comprising a plurality of cleaning sections enclosed within the tubular sheath.

16. The gun barrel cleaning device of claim 9 further comprising an oiling wick for depositing an oil to the inside of the cleaned gun barrel.

17. The gun barrel cleaning device of claim 16 wherein the oiling wick comprises a frayed end of the tubular sheath.

18. The gun barrel cleaning device of claim 9 further comprising a flexible cord attached to the tubular sheath for pulling the cleaning device through the gun barrel.

19. The gun barrel cleaning device of claim 18 further comprising a weight attached to an end of the flexible cord.

20. The gun barrel cleaning device of claim 19 further comprising a rigid or semi-rigid section be attached to said weight.

21. A method for cleaning the inside of a gun barrel in one pass with a gun barrel cleaning device having a first end and a second end which comprises the steps of:

dropping the first end of the gun barrel cleaning device into a first end of the gun barrel;

pulling the gun barrel cleaning device through the inside of the gun barrel by the first end of the gun barrel cleaning device;

scrubbing the inside surface of the gun barrel with a brush connected to and aligned with the length of the gun barrel cleaning device, as the gun barrel cleaning device is pulled through the inside of the gun barrel, loosening debris from the inside of the gun barrel;

cleaning the inside surface of the gun barrel with a cleaning section connected to and aligned with the length of the gun barrel cleaning device, as the gun barrel cleaning device is pulled through the inside of the gun barrel, absorbing and removing debris from the inside of the gun barrel.

22. The method for cleaning the inside of a gun barrel in one pass of claim 21 comprising the additional step of applying a solvent to the cleaning section for assisting the loosening of debris from the inside of the gun barrel.

23. The method for cleaning the inside of a gun barrel in one pass of claim 21 comprising the additional step of applying a gun oil to an oiling wick attached to the gun barrel cleaning device for oiling the inside of the gun barrel.

24. A method for cleaning the inside of a gun barrel in one pass with a gun barrel cleaning device including a tubular sheath having a first end, a second end and a wall and a brush inserted within the tubular sheath, the brush including a brush body and a plurality of bristles extending from the brush body, the plurality of bristles extending through the wall of the tubular sheath, and the gun barrel cleaning device also including a cleaning section, the method for cleaning the inside of a gun barrel in one pass including the following steps:

dropping the first end of the tubular sheath into a first end of the gun barrel;

pulling the tubular sheath through the inside of the gun barrel by the first end of the tubular sheath;

scrubbing the inside surface of the gun barrel with the brush inserted within the tubular sheath as the tubular sheath is pulled through the inside of the gun barrel, loosening debris from the inside of the gun barrel;

cleaning the inside surface of the gun barrel with the cleaning section inserted within the tubular sheath, as the tubular sheath is pulled through the inside of the gun barrel, absorbing and removing debris from the inside of the gun barrel.

* * * * *